United States Patent [19]

Owen, Jr.

[11] Patent Number: 4,620,576

[45] Date of Patent: Nov. 4, 1986

[54] METHOD AND APPARATUS FOR PIERCING A CONTAINER

[75] Inventor: Lorenzo H. Owen, Jr., Marietta, Ga.

[73] Assignee: David R. Owen, Dallas, Ga.

[21] Appl. No.: 680,364

[22] Filed: Dec. 11, 1984

[51] Int. Cl.[4] ..... B65B 3/04

[52] U.S. Cl. ..... 141/1; 141/330; 30/400; 30/436

[58] Field of Search ..... 222/83.5, 87, 88; 83/54; 30/400, 436; 62/294; 137/318; 141/1-12, 19, 329, 330

[56] References Cited

U.S. PATENT DOCUMENTS 3,981,322 9/1976 Gebelius ..... 137/318

4,018,546 4/1977 Gebelius ..... 137/318

*Primary Examiner*—Houston S. Bell, Jr.

*Attorney, Agent, or Firm*—Shlesinger Arkwright Garvey & Fado

[57] ABSTRACT

An apparatus for piercing a container and draining fluid therefrom wherein a vertically movable container holder is provided with an inclined receiving portion having front and rear surfaces with the front surface being elevated with respect to the rear surface. The rear surface includes an opening for receiving a stationary piercing member having a piercing fluid receiving and fluid discharge end. The piercing end is beveled and includes a leading and a trailing edge. The rear surface of the vertically removable container holder includes an opening for receiving the piercing fluid receiving end of the stationary piercing member. The vertically movable container holder opening includes a positioning means adjacent thereto for positioning the bottom of the container with relation to the stationary piercing member. The vertically movable container holder further includes a piercing member guide tube connected at the opening and depending from the rear surface thereof. The piercing member is telescopically and movably positioned within the piercing member guide tube with the leading edge elevated with respect to the trailing edge and the leading edge when in piercing position is adjacent the container positioning means. The vertically movable container holder is moved vertically downward with respect to set stationary piercing member, causing the leading edge of the piercing member to pierce the bottom of a positioned container causing a flap to be formed in the container opening away from the bottom of the container permitting all the fluid remaining in the container to be drained therefrom.

8 Claims, 3 Drawing Figures

2
18
-40-
42
50
52
48
38
16
44
26
-22-
44
20
H
2
24
8
10
4
P
2
32
30
34
28
36
14
12
14
S
6
-40-
-38-
-46-
-2-

METHOD AND APPARATUS FOR PIERCING A CONTAINER

BACKGROUND OF THE INVENTION

The present invention relates to apparatus for piercing a container and more particularly to a container piercing apparatus which provides means for draining fluid released from the pierced container.

Currently, pressurized containers, such as aerosol type dispensers are being used with a variety of products, the primary purpose being to dispense the contained product in metered amounts. A problem has arisen regarding the disposal of the unused or partially used aerosol cans. The cans present a safety hazard with respect to methods of disposing of them without first relieving the pressure contained inside of the can. Heating or crushing pressurized containers can result in explosion and is considered dangerous. Hence, a real need in the art has developed with regard to draining the contained pressurized fluid prior to any subsequent disposal.

Numerous prior art devices exist which attempt to release pressurized fluid from containers such as aerosol cans. U.S. Pat. No. 3,828,976 to Sidelinker, U.S. Pat. No. 3,678,578 to Patton and U.S. Pat. No. 3,333,735 to Odasso all disclose puncturing apparatus which pierces the container at or near an elevated portion of the container allowing the pressurized gas to be released out of this elevated opening.

U.S. Pat. No. 2,259,863 to Smith discloses a strap-on clamp which when locked, urges the can against a stationary piercing member puncturing the lower portion of the can and draining fluid therebelow. U.S. Pat. No. 3,788,519 to Mengel discloses an inwardly tapering spring-biased cup member provided with an opening for admitting a piercing member. The cup and the piercing member are supported for movement relative to one another so that a can positioned on the cup is urged against the stationary piercing member causing a puncture in the can followed by fluid drainage through the piercing member. If it is desired to collect the contents from the pierced containers, it becomes apparent that total drainage is not possible with the prior art devices. Drainage from a puncture near the top of the can will vent the majority of the contained fluid, however the last portions of the fluid to exit the can are often under too low a pressure to adequately flow through the drainage tube. The above mentioned prior art devices which puncture a lower portion of the can do increase the efficiency of the drainage, but do not maximize drainage because of the particular cut made into the can. The piercing member forms a drainage conduit only when positioned inside the can. When the piercing member is withdrawn, no further drainage is possible.

Accordingly, it can be seen that a need exists for a container piercing apparatus of the drainage type, which provides improved drainage when the piercing member is withdrawn from the can.

OBJECTS AND SUMMARY OF THE INVENTION

It is therefore an object of the present invention to provide a novel and improved container piercing apparatus for piercing a container and draining pressurized fluid therefrom.

It is a further object of the present invention to maximize drainage from a pierced container such that substantially no fluid remains in the container after piercing.

It is another object of this invention to provide a method and apparatus for the safe removal of product and propellant from a pressurized container in a safe manner and place them in a container for reuse or disposal.

An additional object of the present invention relates to a container piercing device which can be readily adapted to mechanical, hydraulic or pneumatic actuators.

Yet another object of the present invention is to provide a container piercing apparatus which can be readily reloaded for improved efficiency.

A still further object of the present invention is to provide an improved container piercing apparatus which minimizes pressurized liquid leakage thereby reducing health and environmental hazards and at the same time increasing the percentage of collected fluid.

To summarize this invention, it relates to a method and apparatus for piercing a container and conveying fluid from the punctured container to another location. More specifically, this would include an apparatus having a stationary, beveled piercing member which includes a leading edge and a trailing edge, and an inclined pressurized container holder with a spring biased telescopic tube depending therefrom movable relative to the stationary piercing member. Upon urging of the container holder in a downward, vertical direction, the leading edge of the piercing member will extend upwardly through the tube and enter the container holder such that a can position therein will be pierced and a flap stuck out rearwardly in the bottom of the container thereby permitting substantially all of the fluid remaining in the container to be drained from the container and through the piercing member when the piercing member is withdrawn from the container and the container holder.

These and other objects of this invention will be apparent from the following description and claims.

DESCRIPTION OF THE DRAWINGS

In the accompanying drawings which illustrates by way of example various embodiments of the invention.

DETAILED DESCRIPTION OF THE DRAWINGS

Figures 1, 2, 3:
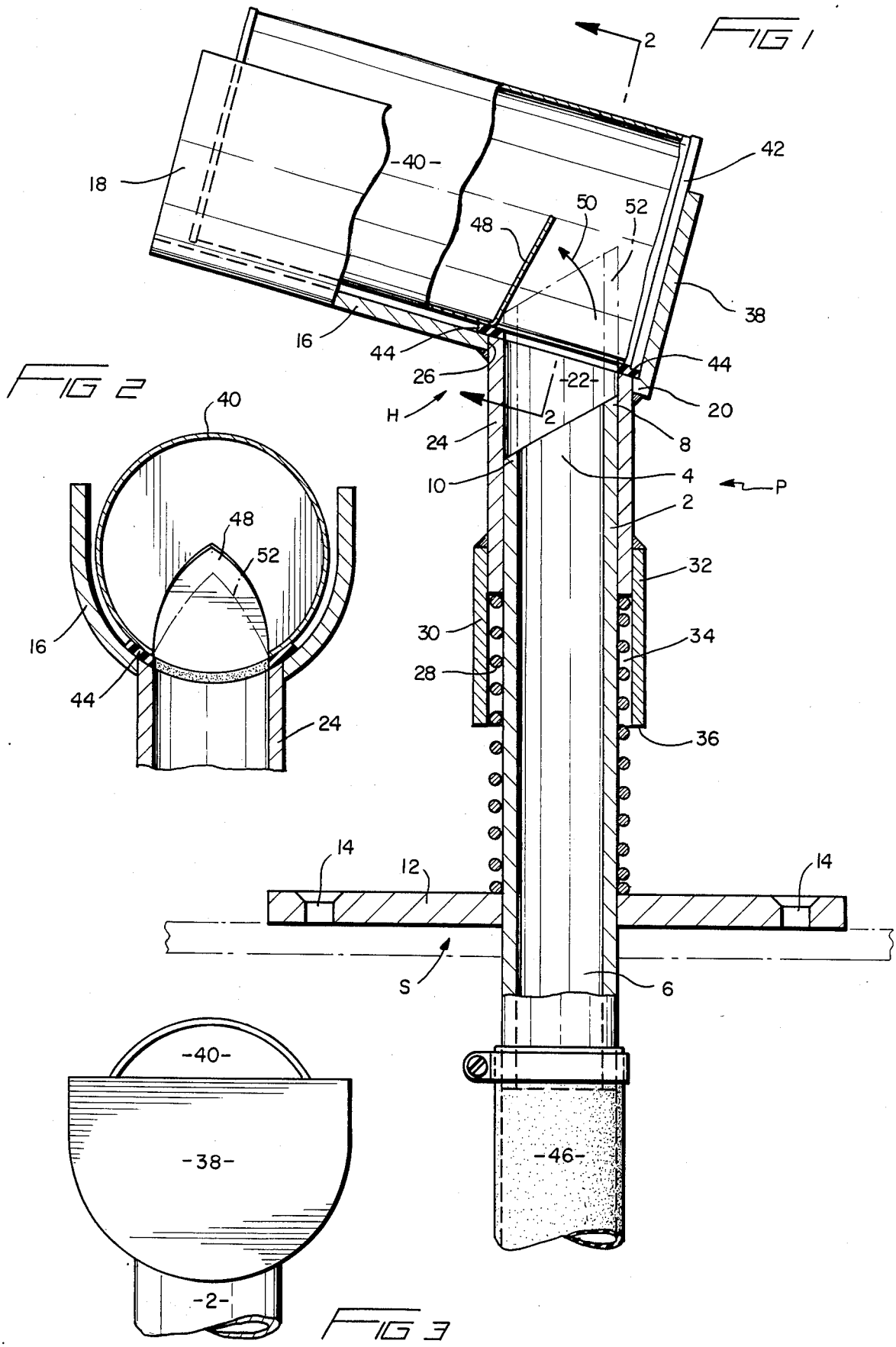
FIG. 1 is a side fragmentary elevation with portions broken away and shown in section and with the piercing member also shown in phantom when piercing the container.
FIG. 2 is a fragmentary cross sectional view along lines 2—2 of FIG. 1.
FIG. 3 is a fragmentary rear elevation of the container holder device illustrated in FIG. 1.

Referring now to the drawings and particularly to FIG. 1, there is shown a container piercing device P. A stationary piercing member 2 generally extends in a vertical direction. The piercing member 2 includes a piercing fluid receiving end 4 at its uppermost portion and a fluid discharge end 6 at its lowermost portion. The piercing fluid receiving end 4 is beveled and includes a leading edge 8 and a lower, trailing edge 10. The piercing end 4 is provided with a sharp surface such that the container to be pierced can be easily punctured in an unrestricted manner.

The stationary piercing member 2 further includes a guide tube stop 12 through which the stationary piercing member 2 extends and to which the stationary piercing member 2 is rigidly attached. The guide tube stop 12 is positioned at the lower portion of the stationary piercing member tube 2. Preferably, this would be near the fluid discharge end 6 of the piercing member tube 2. The guide tube stop 12 is adapted to be rigidly mounted to any surfaces such as a drum or barrel or other type receptacle for collecting the fluid contents of the container to be pierced. Screw hole 14 is shown for such attachment. It should be understood however that any conventional means of attachment is applicable and that variations and modifications for attachment can be effected within the scope of the invention. A vertically movable container holder H includes a generally inclined receiving portion 16 which further comprises a front surface 18 and a rear surface 20. The front surface 18 of the inclined receiving portion 16 is substantially elevated at at least about 15° with respect to the rear surface 20 of the receiving portion 16 in order to adequately drain the pierced receptacle.

The rear surface 20 of the inclined receiving portion 16 further includes an opening 22 through which the piercing fluid receiving end 4 of the piercing member 2 may travel. Secured to and depending from the opening 22 at the rear surface of the inclined receiving portion 16 is a piercing member guide tube 24. The point of attachment such as a weld, is indicated at 26. A sleeve 30 is secured to the outside of guide tube 24 at the upper end 32 of the sleeve 30 and is spaced from the piercing member 2 such that a spring receiving space 34 is thereby formed around the piercing member 2. A spring 28 is positioned in the spring receiving space 34. It will be appreciated by those having ordinary skill in the art that any adaptable biasing means may be incorporated in place of the coil spring 28 and still lie within the scope and spirit of the invention. The primary concern is to provide a means for urging the vertically movable container holder H upwards. The sleeve 30 terminates at the edge stop surface 36.

The inclined receiving portion 16 of the vertically movable container holder H is provided with a container positioning means 38 attached at rear surface 20 of the container holder H and extends in a generally vertical direction at right angles inclined from receiving portion 16.

Referring to FIG. 3, it can be seen that the positioning means 38 provides a stop for the container 40 at the end 42 thereof, whereby the container 40 is maintained in a correct position for the piercing process. A resilient seal means 44, such as a rubber or silicon o-ring is provided on the interior of the inclined receiving portion 16 and along the periphery of the opening 22 thereby limiting leakage of fluid or gas between the container 40 and the container piercing device P. Numerous resinous seal compositions exist in the art and it is not the intention of the present invention to be limited by a particular seal. Any and all seal compositions which provide a liquid and gas-type tight joint are preferred and inclusive within the scope of the present invention.

The fluid discharge end 6 of the stationary piercing member 2 has attached thereto a discharge hose 46 which is in turn connected to a suitable container 40 for the collection of the drained fluid.

In order to best understand the present invention, a typical sequence of operation will now be described in detail. As best shown in FIGS. 1 and 2 a container 40 to be punctured and drained is positioned in the vertically movable container holder H so that it is resting in an inclined position. The sealed container 40 is pushed in a vertically downward direction with respect to the stationary piercing member tube 2. The container 40 may be manually moved by an operator of the device P or may be automatically moved by suitable mechanical, hydraulic or pnuematic means therefore (not shown). The telescopic positioning of the stationary piercing member 2 within the piercing member guide tube 24 allows relative movement therebetween. Continued movement of the container 40 along a downward direction simultaneously enables a corresponding, relative movement of the piercing member 2 to occur in an upwards direction through the guide tube 24. Accordingly, the leading edge 8 of the piercing member 2 will pass through opening 22 of the container holder and engage and pierce the container 40 forming a tear 48 in the side of the container which extends from the lowermost portion of the container towards the front of the container. Arrow 50 indicating direction of travel of the tear 48. Extended movement of the leading edge 8 of the piercing member 2 into the container 40 allows the trailing edge 10 of the piercing member 2 to similarly enter the container 40 and extend the tear 48. Phantom lines 52 indicate the piercing position of piercing member 2. The upper limit of piercing member 2 movement into the container 40 is reached when the edge stop surface 36 of the sleeve 30 makes contact with the guide tube stop 12. It is appreciated that the regulation of the depth in which the piercing member may enter the container is directly related to the length of the sleeve 30. Modifications to the sleeve length can be made in conjunction with desired operational characteristics.

Fluid which is contained under pressure in the container 40 is immediately released through the piercing fluid receiving end 4 of the piercing member 2, conveyed along a path towards the fluid discharge end 6 for eventual containment at a selected location via the discharge hose 46. When downward pressure on the container 40 is released, the spring 28 urges the piercing member guide tube 24 and associated container holder H upwardly causing the withdrawal of the piercing member 2 from the pierced container 40 and back into its recessed position within the piercing member guide tube 24. Any fluid remaining in the container is now able to drain through the opening 22 and into the piercing member 2 and down the discharge hose 46 into a receptacle or the like (not shown).

While this invention has been described as having a preferred design, it will be understood that it is capable of further modifications. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. The method for draining fluid from a container by piercing the bottom of the container comprising the steps of;

a. positioning said container in a substantially vertically movable container holder so that the container is inclined in the container holder with the top of the container substantially elevated with respect to the bottom of the container;

b. positioning the container in the container holder so that the bottom of the container is in close proximity to a piercing member;

c. providing a piercing member having drainage means therein and having a front piercing edge and having a beveled piercing edge with the bevel extending in an inclined fashion so that the top piercing edge of the bevel upon piercing the container engages the rearmost portion of the bottom of the container;

d. applying a downward motion to the container and the container holder whereby to force said piercing member into said container and simultaneously cause a tear to be struck from the container in a direction from the bottom of the container towards the top of the container;

e. withdrawing the piercing member substantially from the container; and, f. drawing the material from the container through the piercing member and into a storage receptacle;

g. and removing said container from said container holder and replacing and repeating the process with a new container.

2. A method as in claim 1 and wherein;

a. a seal means is provided between said container and said vertically movable container holder thereby restricting leakage of said material therebetween.

3. An apparatus for piercing a container having a top and a bottom and draining fluid therefrom, comprising:

(a) a stationary piercing and fluid discharging member having a piercing, fluid receiving end, and a fluid discharge end in fluid communication with said fluid receiving end;

(b) said piercing end being beveled and including a leading and a trailing edge;

(c) a vertically movable container holder including an inclined receiving portion having front and rear surfaces with said front surface being elevated with respect to said rear surface;

(d) said rear surface including an opening for receiving said piercing fluid receiving end;

(e) said rear surface including container positioning means adjacent said opening for positioning the bottom of said container with relation to said stationary piercing and fluid discharging member;

(f) said rear surface including a piercing member guide tube connected at said opening and depending from said rear surface;

(g) said piercing member guide tube including a stop means for limiting the downward movement of said container holder;

(h) said piercing and fluid discharging member telescopically and movably positioned within said piercing member guide tube with said leading edge elevated with respect to said trailing edge and said leading edge when in piercing position being adjacent said container positioning means;

(i) wherein when said container holder having a container positioned therein is moved vertically downward with respect to said stationary piercing and fluid discharging member, said leading edge of said stationary piercing and fluid discharging member will pierce the bottom of said container adjacent said container positioning means and cause a tear to be initially formed in said container opening away from the bottom of said container to thereby permit substantially all of the fluid remaining in the container to be drained from said container into said piercing fluid receiving end and thus into said fluid discharge and when said piercing fluid receiving end is withdrawn from said container by subsequently moving said container holder vertically upwards.

4. An apparatus as in claim 3 and wherein said vertically movable container holder is spring biased.

5. An apparatus as in claim 4 and wherein:

(a) said guide tube including a sleeve connected thereto and spaced from said piercing and fluid discharging member; and, (b) spring means positioned in said sleeve for normally biasing said container holder vertically upward on said piercing and fluid discharging member.

6. An apparatus as in claim 3, wherein:

(a) said container holder having a seal means about said opening for engaging the outer surface of said container to prevent fluid from escaping outside of said fluid receiving end.

7. An apparatus as in claim 3, wherein:

(a) said container positioning means including an edge stop surface.

8. An apparatus as in claim 3 and further comprising (a) a fluid receptacle attached to said fluid discharge end.

* * * * *